United States Patent [19]

Pfefferle

[11] 4,287,090

[45] Sep. 1, 1981

[54] METHOD OF TREATING FLUE DEPOSITS AND COMPOSITION THEREFOR

[76] Inventor: William C. Pfefferle, 51 Woodland Dr., Middletown, N.J. 07748

[21] Appl. No.: 61,869

[22] Filed: Jul. 30, 1979

[51] Int. Cl.[3] ..... B01J 31/04

[52] U.S. Cl. ..... 252/428; 252/431 C; 252/471; 134/2

[58] Field of Search ..... 252/428, 431 C, 471

[56] References Cited

U.S. PATENT DOCUMENTS

| | | | |
|---|---|---|---|
| 3,598,650 | 8/1971 | Lee | 252/454 X |
| 3,684,576 | 8/1972 | Eisen et al. | 252/430 X |
| 3,800,466 | 4/1974 | Heit | 44/51 X |
| 4,049,790 | 9/1977 | Horowitz et al. | 252/471 X |
| 4,053,533 | 10/1977 | Drehman et al. | 252/471 X |
| 4,092,370 | 5/1978 | Ichiki et al. | 252/471 X |

OTHER PUBLICATIONS

Langes's Handbook of Chemistry, Ninth Edition, (1956), published by Handbook Publishers Inc., Sandusky, Ohio, pp. 240–245, 250–253, 258, 268–273, 276–283, 286–289, 296–299 & 324.

*Primary Examiner*—Patrick Garvin
*Attorney, Agent, or Firm*—Hayes & Reinsmith

[57] ABSTRACT

A water solution of a mixture of catalytically-active metal salts comprising manganous acetate, calcium nitrate and cupric acetate is sprayed or "misted" into and on a burning wood fire and the walls of the firebox whereby the active agents are carried up and onto the flue walls to effect reduction and/or removal of tars, creosote and other wood-burning by-products deposited on the firebox and flue walls.

3 Claims, No Drawings

METHOD OF TREATING FLUE DEPOSITS AND COMPOSITION THEREFOR

FIELD OF INVENTION

This invention relates to a method for reducing and minimizing as well as removing the build-up tars, creosote and other wood burning by-products that are deposited on the walls of a fireplace and the flue or stack; more particularly, the invention is concerned with utilizing catalytic techniques with the movement of air and combustion by-products of the fire itself to effect reduction and removal of such by-products in the flue or stack.

BACKGROUND OF THE INVENTION

The combustion of wood in a fireplace or stove results in the pyrolysis of a significant fraction of the wood thereby producing wood tars and soot which are carried about the fireplace and up the flue by the rapidly rising hot combustion gases. Wood tar includes both liquid and solid components, the tar often further being distilled by the heat to form creosote, wood pitch and, of course, soot. Because the walls of the firebox and the flue are comparatively cool, particularly when the fire has been burning for a relatively short time, the vaporized tars condense on the surfaces of the firebox and flue. A sticky deposit is formed to which soot particles readily adhere and the build-up of such deposits provides the opportunity for dangerous flue fires.

The use of catalysts to promote combusion of organic substances, including elemental carbon, below their autoignition temperatures is known. U.S. Pat. No. 3,684,576 to Eisen et al discloses use of various catalysts including platinum and cobalt acetal acetonate disposed on top of a substance to remove such substance from a metal substrate at a temperature somewhat below 400 degrees centigrade, 350 degrees centigrade being described as a practical lower limit. U.S. Pat. No. 3,598,650 to Lee discloses the inclusion of a metal oxide, preferably cobalt, in the vitreous porcelain enamel lining of an area to effect self-cleaning action at temperatures above 350 degrees centigrade. U.S. Pat. No. 3,800,466 to Heit addresses the problem of the black liquor by-product of paper-making processes and the slag resulting from the combustion of the aqueous alkaline fuel (black liquor) in recovery boilers. Heit discloses the use of water-soluble salts of a catalyst metal selected from the group consisting of manganese, copper, iron, tin, nickel, cobalt and mixtures thereof. A sequestering agent is added to the alkaline pH aqueous solution of the catalyst metals and the resulting mixture is mixed with the aqueous fuel (black liquor) just prior to its injection into the combustion zone of the recovery boiler.

OBJECTS OF THE INVENTION

It is therefore a principal object of this invention to provide an improved method of using catalyst techniques to remove tars, soot and other by-products of burning wood from the firebox walls and firebox flue of a typical home fireplace or stove.

It is a further object of this invention to provide a simple and safe home-use method for removing as well as minimizing the build-up of tars and soot deposits on fireplace and wood stove flues at the low temperatures occasioned by normal use.

It is a still further object of this invention to provide a low-cost aqueous catalyst solution which is effectively delivered to a fireplace flue by normal wood combustion to remove and/or reduce flue tar and soot build-up.

These and other objects will be in part obvious and in part pointed out in more detail hereinafter.

A better understanding of the objects, advantages, features, and properties of the invention will be obtained from the following detailed description which sets forth certain illustrative embodiments indicative of various ways in which the principles of the invention are employed.

SUMMARY OF THE INVENTION

I have found that addition of water-soluble metal salts such as acetates or nitrates to water to form an aqueous solution that can be sprayed or "misted" into a fire in progress permits the transportation of the metal catalyst ions into the flue where the build-up of tars and soot is most dangerous. The catalyst promotes decomposition of the tars and soot to oxides at the comparatively low temperatures normally present in the flue during use. I have also found that the use of water soluble salts of manganese and copper with a water soluble salt of calcium, in the proportions hereinafter described, produces effective low temperature catalyst reduction of soot and tars.

DESCRIPTION OF THE INVENTION

Home fireplace and wood stove flue-cleaning has become a significant safety problem because of the increased use of wood as a fuel, the limited availability of commercial cleaning services, and the general unfamiliarity of home owners with the necessity for such cleaning. Moreover, commercially-available products are difficult to use and are often of questionable efficacy.

Known catalyst techniques require direct application of a substance directly to the tar and/or soot deposit followed by provision of an elevated temperature for the surface on which the tar, etc. is deposited. Moreover, catalyst selection often presented significant cost problems.

The present invention provides an aqueous solution of comparatively inexpensive metal salts, which solution is easily stored, non-flamable and safe for the user. By using that solution in a common hand pump sprayer, the catalytic materials can be delivered in finely divided or "misted" form directly into the fireplace (or firebox of a stove). Such injection of the catalyst mist is accomplished while the fire is in progress so that the catalyst is not only deposited on the fireplace walls but is also carried up the flue by the hot products of combustion to be deposited on the flue walls and thus, on any tars, soot or the like which have been previously deposited on those walls from prior wood fires.

EXAMPLE I

Typically, water soluble salts of metals found in groups 6b, 7b or 8 of the periodic table of elements can be utilized in my improved spraying or "misting" method with an active wood fire. It has been found, however, that the following metal salts in the proportions noted provides a suitable fireplace and flue treatment in accordance with my improved method:

40 grams manganous acetate
20 grams calcium nitrate
10 grams cupric acetate
1 liter water The ingredients are fully mixed and dissolved in the water and the resulting solution is placed in any suitable sprayer such as a conventional hand pump sprayer capable of providing a fine spray or mist output. Approximately 400 milliliters of the solution was sprayed into a fireplace containing a normal wood fire. In approximately 20 minutes deposits visible from outside the fireplace had substantially disappeared after cooling, the fireplace flue was visually examined and it was found that tar deposits (glossy black) had changed to a dull matte surface with only small glossy patches remaining thereby indicating reduction of the tar.

EXAMPLE II

A solution was prepared by dissolving 5 grams of cupric acetate, 20 grams of manganous acetate and 10 grams of calcium nitrate in one liter of water. About 200 milliliters of this solution was sprayed, using a hand pump spray dispenser, into one side of a fireplace containing a burning fire. Before treatment the fireplace had been used for over ten years and was heavily encrusted with soot and tar deposits. In less than twenty minutes after treatment the deposits visible from outside the fireplace had disappeared from the surfaces exposed to the spray. The untreated side showed no change. After the fire had gone out and the fireplace was cool enough for inspection, the upper flue was visually examined. The flue surfaces were found to have changed in appearance from glossy black finish (tarry deposits) to a dull matte surface with only patches of glossy surface remaining.

EXAMPLE III

To further test the efficacy of the solution of example I, a small fire was built in the aforementioned fireplace. A small amount of catalyst solution was sprayed onto a portion of the fireplace wall still coated with tarry deposits. Although the surface was still below the boiling point of water, the deposits disappeared by the time the dampened surface had dried.

EXAMPLE IV

A solution was prepared by dissolving 30 grams of manganous acetate, 10 grams of ferric nitrate, and 10 grams of strontium nitrate in 300 milliliters of water, 25 milliliters of this solution was diluted with 50 milliliters of water and the diluted solution was sprayed into a lightly sooted fire-place containing a burning fire. After several hours the fire was allowed to go out and the fireplace was examined. Soot deposits on accesible surfaces were greatly reduced and no creosote deposits were visible.

EXAMPLE V

A solution was prepared by dissolving 10 grams of cupric acetate in 100 milliliters of water. About 30 milliliters of this solution was diluted with water with about 60 milliliters and sprayed onto sooted surfaces in a fireplace in which a wood fire was burning. The fire was allowed to burn for several hours and the treated areas were then examined. Very little soot removal was observed.

Under appropriate circumstances, the solution of this invention can be brushed on exposed surfaces of a fireplace to be used shortly with good results.

Variations in the formulation of a solution useful in this method are expected. For example, the amount of manganous acetate can range from 10 grams to its limit of solubility, the amount of copper acetate can range from 5 grams to its limit of solubility, and the amount of calcium nitrate can range from 5 to 40 grams. Moreover, other soluble metal salts can be used, but in the preferred embodiment of Examples I and II, the soluble manganese and copper salts provide necessary metal ion for catalytic action, the calcium salt serving to improve the adhesion of the spray mist to the walls of the fireplace and its flue.

From the foregoing description, it is apparent that I have disclosed a unique method for treating tar and soot accumulations in fireplaces and flues and a unique formulation for a water soluble catalytically active mixture for effectively reducing such tars and soot when used with my method.

As will be apparent to persons skilled in the art, various modifications, adaptations and variations of the foregoing specific disclosure can be made without departing from the teachings of the present invention.

I claim:

1. An aqueous catalytic solution for removing tar deposits by spraying the solution into a firebox and its flue during or immediately following normal use of the firebox comprising a solution containing at least 10 grams of a water soluble salt of manganese and at least 5 grams of at least one additional water soluble salt selected from the group consisting of water soluble copper salts and water soluble calcium salts dissolved in a liter of water.

2. The aqueous catalytic solution of claim 1 wherein said solution includes at least 10 grams of a water soluble salt of manganese, at least 5 grams of a water soluble copper salt, and at least 5 grams of a water soluble calcium salt.

3. The aqueous catalytic solution as set forth in claim 1 wherein said solution contains at least 20 grams of manganese acetate, at least 10 grams of calcium nitrate, and at least 5 grams of copper acetate.

* * * * *